US007644738B2

(12) United States Patent
Kroll et al.

(10) Patent No.: US 7,644,738 B2
(45) Date of Patent: Jan. 12, 2010

(54) THROUGH AIR DRYING FABRIC

(75) Inventors: Lynn F. Kroll, Sherwood, WI (US); John J. LaFond, Appleton, WI (US)

(73) Assignee: Albany International Corp., Albany, NY (US)

( * ) Notice: Subject to any disclaimer, the term of this patent is extended or adjusted under 35 U.S.C. 154(b) by 81 days.

(21) Appl. No.: 11/729,041

(22) Filed: Mar. 28, 2007

(65) Prior Publication Data

US 2008/0236699 A1 Oct. 2, 2008

(51) Int. Cl.

| | |
|---|---|
| ***D21F 1/10*** | (2006.01) |
| ***D21F 7/08*** | (2006.01) |
| ***D03D 3/04*** | (2006.01) |
| *D03D 25/00* | (2006.01) |

(52) U.S. Cl. ..... 139/383 A; 139/383 AA; 139/383 R; 162/358.2

(58) Field of Classification Search ..... 139/383 R, 139/383 A, 383 AA, 408, 411, 412, 413, 139/414; 162/348, 358.1, 358.2, 900, 902, 162/903, 904

See application file for complete search history.

(56) References Cited

U.S. PATENT DOCUMENTS

| | | | | | |
|---|---|---|---|---|---|
| 3,545,705 | A | * | 12/1970 | Hodgson | 245/8 |
| 3,632,068 | A | * | 1/1972 | Weir et al. | 245/8 |
| 3,858,623 | A | * | 1/1975 | Lefkowitz | 139/425 A |
| 3,974,025 | A | | 8/1976 | Ayers | |
| 4,142,557 | A | * | 3/1979 | Kositzke | 139/425 A |
| 4,157,276 | A | * | 6/1979 | Wandel et al. | 162/348 |
| 4,161,195 | A | * | 7/1979 | Khan | 139/383 A |
| 4,184,519 | A | * | 1/1980 | McDonald et al. | 139/425 A |
| 4,191,609 | A | | 3/1980 | Trokhan | |
| 4,239,065 | A | * | 12/1980 | Trokhan | 139/383 AA |
| 4,281,688 | A | * | 8/1981 | Kelly et al. | 139/383 A |
| 4,359,069 | A | * | 11/1982 | Hahn | 139/425 A |
| 4,359,501 | A | | 11/1982 | DiTullio | |
| 4,376,455 | A | * | 3/1983 | Hahn | 139/383 A |
| 5,169,499 | A | | 12/1992 | Eagles et al. | |
| 5,228,482 | A | | 7/1993 | Fleischer | |
| 5,542,455 | A | | 8/1996 | Ostermayer et al. | |
| 5,832,962 | A | | 11/1998 | Kaufman et al. | |
| 5,853,547 | A | | 12/1998 | Ahrens et al. | |
| 6,592,714 | B2 | | 7/2003 | Lamb | |
| 6,649,026 | B2 | | 11/2003 | Lamb | |
| 6,708,732 | B1 | | 3/2004 | Hay et al. | |

FOREIGN PATENT DOCUMENTS

| | | |
|---|---|---|
| WO | WO 96/04418 | 2/1996 |
| WO | WO 97/24488 | 7/1997 |

OTHER PUBLICATIONS http://www.thefreedictionary.com/Floating+threads. Definition of "floating threads".*

* cited by examiner

*Primary Examiner*—Bobby H Muromoto, Jr.
(74) *Attorney, Agent, or Firm*—Frommer Lawrence & Haug LLP; Ronald R. Santucci

(57) ABSTRACT

A through-air-drying (TAD) fabric for producing tissue paper and related products on a papermaking machine comprising a plurality of warp yarns interwoven with a plurality of weft yarns to produce warp and weft knuckles on a paper-side surface of the fabric, preferably to form an L-shaped knuckle pattern.

30 Claims, 2 Drawing Sheets

THROUGH AIR DRYING FABRIC

BACKGROUND OF THE INVENTION

1. Field of the Invention

The present invention relates to the papermaking arts. More specifically, the present invention relates to through-air-drying (TAD) fabrics used in the manufacture of bulk tissue and towel, and of nonwoven articles and fabrics.

2. Description of the Prior Art

Soft, absorbent disposable paper products, such as facial tissue, bath tissue and paper toweling, are a pervasive feature of contemporary life in modern industrialized societies. While there are numerous methods for manufacturing such products, in general terms, their manufacture begins with the formation of a cellulosic fibrous web in the forming section of a paper machine. The cellulosic fibrous web is formed by depositing a fibrous slurry, that is, an aqueous dispersion of cellulose fibers, onto a moving forming fabric in the forming section. A large amount of water is drained from the slurry through the forming fabric, leaving the cellulosic fibrous web on the surface of the forming fabric.

The cellulosic fibrous web is then transferred to a through-air-drying (TAD) fabric or belt by means of an air flow, brought about by vacuum or suction, which deflects the web and forces it to conform, at least in part, to the topography of the TAD fabric or belt. Downstream from the transfer point, the web, carried on the TAD fabric or belt, passes through a through-air dryer, where a flow of heated air, directed against the web and through the TAD fabric or belt, dries the web to a desired degree. Finally, downstream from the through-air dryer, the web may be adhered to the surface of a Yankee dryer and imprinted thereon by the surface of the TAD fabric or belt, for further and complete drying. The fully dried web is then removed from the surface of the Yankee dryer with a doctor blade, which foreshortens or crepes the web and increases its bulk. The foreshortened web is then wound onto rolls for subsequent processing, including packaging into a form suitable for shipment to and purchase by consumers.

As noted above, there are many methods for manufacturing bulk tissue products, and the foregoing description should be understood to be an outline of the general steps shared by some of the methods. For example, the use of a Yankee dryer is not always required, as, in a given situation, foreshortening may not be desired, or other means, such as "wet creping", may have already been taken to foreshorten the web.

It should be appreciated that TAD fabrics may take the form of endless loops on the paper machine and function in the manner of conveyors. It should further be appreciated that paper manufacture is a continuous process which proceeds at considerable speeds. That is to say, the fibrous slurry is continuously deposited onto the forming fabric in the forming section, while a newly manufactured paper sheet is continuously wound onto rolls after it is dried.

Those skilled in the art will appreciate that fabrics are created by weaving, and have a weave pattern which repeats in both the warp or machine direction (MD) and the weft or cross-machine direction (CD). Woven fabrics take many different forms. For example, they may be woven endless, or flat woven and subsequently rendered into endless form with a seam. It will also be appreciated that the resulting fabric must be uniform in appearance; that is, there are no abrupt changes in the weave pattern to result in undesirable characteristics in the formed paper sheet. In addition, any pattern marking imparted to the formed tissue will impact the characteristics of the paper.

Contemporary papermaking fabrics are produced in a wide variety of styles designed to meet the requirements of the paper machines on which they are installed for the paper grades being manufactured. Generally, they comprise a base fabric woven from monofilament and may be single-layered or multi-layered. The yarns are typically extruded from any one of several synthetic polymeric resins, such as polyamide and polyester resins, used for this purpose by those of ordinary skill in the paper machine clothing arts.

The present application is concerned, at least in part, with the TAD fabrics or belts used on the through-air dryer of a bulk tissue machine although it may have other applications beyond this. However, the present application is primarily concerned with a TAD fabric.

Such fabric may also have application in the forming section of a bulk tissue or towel machine to form cellulosic fibrous webs having discrete regions of relatively low basis weight in a continuous background of relatively high basis weight. Fabrics of this kind may also be used to manufacture nonwoven articles and fabrics, which have discrete regions in which the density of fibers is less than that in adjacent regions whereby the topography of the nonwoven article is changed, by processes such as hydroentanglement.

The properties of absorbency, strength, softness, and aesthetic appearance are important for many products when used for their intended purpose, particularly when the fibrous cellulosic products are facial or toilet tissue, paper towels, sanitary napkins or diapers.

Bulk, tensile, absorbency, and softness are particularly important characteristics when producing sheets of tissue, napkin, and towel paper. To produce a paper product having these characteristics, a fabric will often be constructed so that the top surface exhibits topographical variations. These topographical variations are often measured as plane differences between strands in the surface of the fabric. For example, a plane difference is typically measured as the difference in height between a raised weft or warp yarn strand or as the difference in height between MD knuckles and CD knuckles in the plane of the fabric's surface. Often, the fabric surface will exhibit pockets in which case plane differences may be measured as a pocket depth.

A close study of the designs discussed above showed that both warp and weft yarns are primarily responsible for the creation of the depth of the pocket, thus limiting caliper generation. An ideal TAD fabric should provide for both MD and CD contact, thus facilitating sheet transfer to the Yankee dryer, enhancing the TAD fabric operation in the manufacturing process and enhancing creping at the end of the process.

U.S. Pat. No. 6,649,026 relates to a PMC fabric with a web pattern which recurs regularly over the surface and has indentations that are formed by the thread overlays, the latter having been surface ground. The thread overlays cover three consecutive warp or weft threads crosswise thereto. The fabric according to the '026 patent, however, provides for boxed shaped patterns, which fail to provide enhanced MD and CD support.

U.S. Pat. No. 6,592,714 relates to a woven TAD fabric. The relative pocket depths of the fabric which are open towards the contact surface of the paper are 20% or more. The pattern disclosed herein is also boxed shaped and therefore fails to provide enhanced MD and CD support.

U.S. Pat. No. 6,708,732 relates to a web forming fabric which includes first and second substantially linear arrays of systematically distributed areas of high drainage on one side thereof. These linear arrays are oriented at an acute angle to the machine direction and at an acute angle to each other. The boundaries of each of the systematically distributed areas are defined by two pairs of adjacent sides; the adjacent sides of one pair being angled segments of one transversely extending yarn and the adjacent sides of the other pair being angled segments of a second transversely extending yarn contiguous to the one transversely extending yarn. The opposite side of the fabric has long machine direction floats over adjacent transverse yarns and the machine direction floats of adjacent machine direction yarns partially overlap each other in the machine direction. However, in this case only MD yarns produce high drainage areas, and thus, is limited to support in MD only.

U.S. Pat. No. 5,832,962 relates to a papermaking fabric containing a number of relatively long warp knuckles at locations where one of the warp threads crosses over at least four of the shute threads. The long warp knuckles are positioned in a shed pattern to form a first axis of bulky ridges that are defined by long warp knuckles positioned next to each other on adjacent warp threads, the first axis being disposed at a first angle with respect to the cross-direction of the drying fabric that is substantially between 68 and 90 degrees; and a second axis formed by each of the long warp knuckles with other, overlapping long warp knuckles on nearby, but not immediately adjacent, warp threads, the second axis forming a second angle with respect to the cross-direction of the drying fabric of less than about 28 degrees. The '962 patent, however, teaches a top surface plane with long knuckles only in warp direction and a diagonal trough pattern. The fabric is also limited to MD support.

U.S. Pat. No. 3,974,025 relates to an absorbent paper sheet exhibiting a diamond-shaped pattern in its surface after creping. The paper sheets are produced by impressing a dot-dash knuckle pattern, wherein the long axis of the dash impressions is aligned parallel to the machine direction of papermaking, using the back side of a monofilament, polymeric fiber, semi-twill fabric of selected coarseness, the knuckle imprint area of which constitutes between about 20 and about 50 percent of the total fabric surface area, as measured in the plane of the knuckles on an uncompacted paper web at selected fiber consistencies induced by thermal predrying prior to final drying and creping. This patent uses a dot-dash pattern which is a non continuous and broken MD & CD pattern and mainly focuses on pockets. An ideal TAD fabric should provide for both MD and CD contact, facilitating sheet transfer to the Yankee dryer, enhancing the TAD operation in the manufacturing process and enhancing creping at the end of the process.

The present invention provides an improved TAD fabric which exhibits favorable characteristics for the formation of tissue paper and related products.

SUMMARY OF THE INVENTION

The present invention is primarily directed towards a through-air-drying (TAD) fabric, although it may also tend to be used in the forming, press and dryer sections of a paper machine.

The present invention is preferably a TAD fabric comprising a plurality of warp yarns interwoven with a plurality of weft yarns to produce a paperside surface pattern characterized by long knuckles in both warp and weft directions.

It is therefore an object of the present invention to provide for a fabric that has improved MD and CD contact area, thus facilitating sheet transfer to the Yankee dryer.

It is another object of the present invention to provide for enhanced creping.

It is also an object of the present invention to provide suitable pockets for enhanced sheet appearance in order to improve sheet properties such as bulk and absorbency.

It is also an object of the present invention to provide suitable pockets for enhanced sheet appearance and sheet properties such as bulk and absorbency.

Other embodiments of the present invention can include fabrics implementing different weave patterns and yarn combinations than that illustrated and discussed with or without one or more layers of a surface coating.

The present invention will now be described in more complete detail with frequent reference being made to the drawing figures, which are identified below.

BRIEF DESCRIPTION OF THE DRAWINGS

To the accomplishment of the foregoing and related ends, certain illustrative aspects of the invention are described herein in connection with the following description and the annexed drawings. These aspects are indicative, however, of but a few of the various ways in which the principles of the invention may be employed and the present invention is intended to include all such aspects and their equivalents. Other advantages and novel features of the invention may become apparent from the following description of the invention when considered in conjunction with the drawings. The following description is given by way of example, but is not intended to limit the invention solely to the specific embodiments described and may best be understood in conjunction with the accompanying drawings, in which.

DETAILED DESCRIPTION

It is noted that in this disclosure and particularly in the claims and/or paragraphs, terms such as "comprises," "comprised," "comprising," and the like can have the meaning attributed to it in U.S. patent law; that is, they can mean "includes," "included," "including," "including, but not limited to" and the like, and allow for elements not explicitly recited. Terms such as "consisting essentially of" and "consists essentially of" have the meaning ascribed to them in U.S. patent law; that is, they allow for elements not explicitly recited, but exclude elements that are found in the prior art or that affect a basic or novel characteristic of the invention. These and other embodiments are disclosed or are apparent from and encompassed by, the following description.

The present invention relates to industrial fabrics for use on a papermaking machine. Industrial fabrics, as referred to herein, include an impression fabric, a tissue forming fabric, a texturing or impression fabric for the production of nonwovens and TAD fabrics for use on a papermaking machine. According to an embodiment of the present invention, the invention is a TAD fabric and the method of making it. The fabric comprising of a plurality of warp and weft yarns interwoven to form the base fabric structure. The fabric can be formed using any weave pattern suitable for the purpose and can be formed from a wide selection of monofilament yarns known in the art of paper machine clothing, as will be discussed. The fabric, in general, forms long knuckles in the warp direction, wherein warp yarns float over two or more weft yarns to form MD knuckles. Selected portions of either or both warp and weft knuckles are flattened via sanding, calendering, machining or by other means, whereby the fabric contact with the sheet is increased and thus facilitating sheet transfer to the Yankee dryer, enhanced creping in the end of the process, and better defining the pocket area with the advantages attendant thereto.

Figure 1:
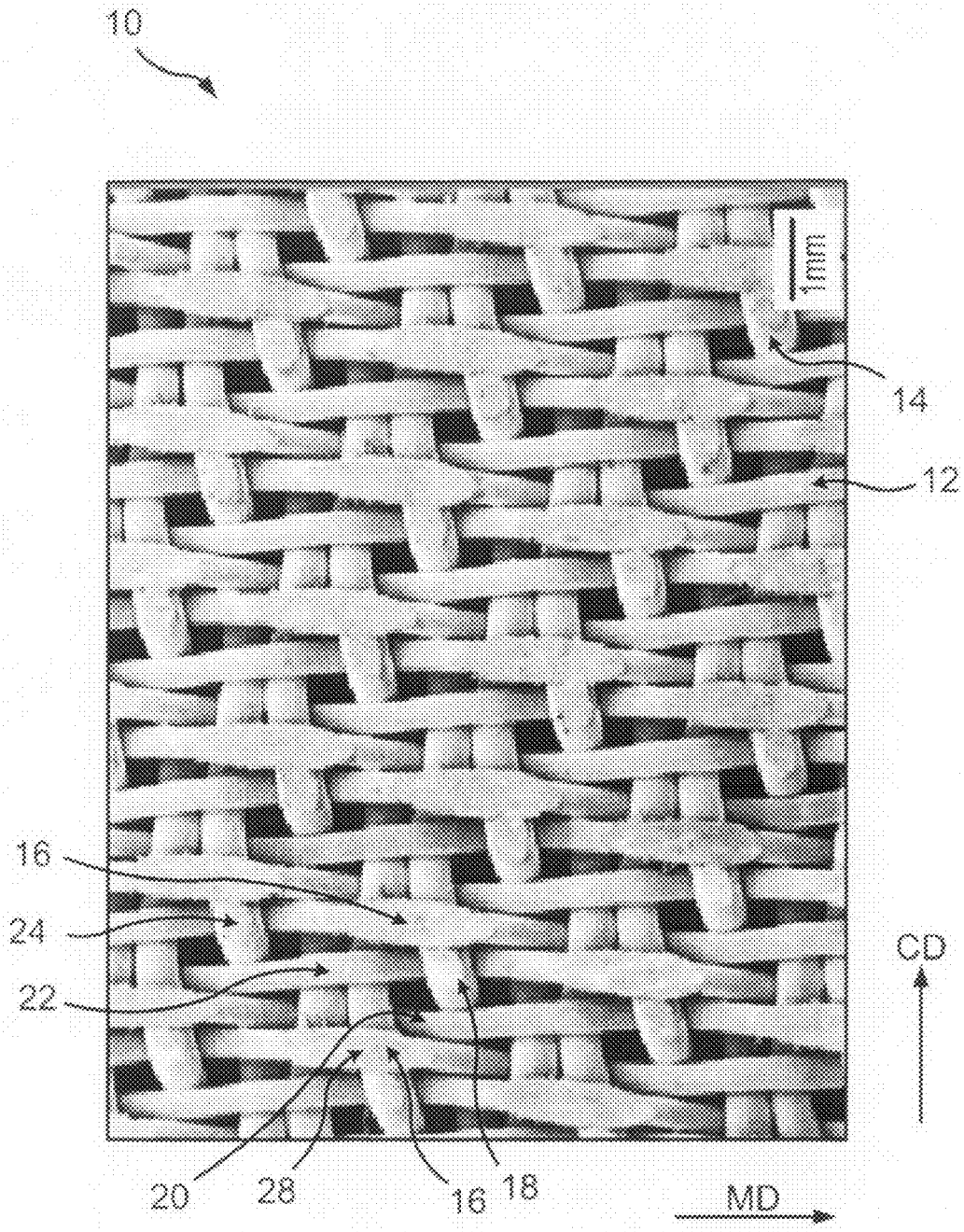
FIG. 1 shows a paper side view and a surface depth view highlighting the MD and CD knuckles on the paper side surface of a preferred embodiment of the present invention.

Turning now, more particularly, to the figures, FIG. 1 is a plan view of one side of fabric 10, which is preferably its forming side or paper side. The paper side is so-called because it is the side which faces the newly formed paper web when the fabric 10 is a fabric running on a paper machine. The fabric 10 is woven from a plurality of warp yarns 12 and weft yarns 14.

Warp yarns 12 and weft yarns 14 are in the machine direction ("MD") and cross-machine direction ("CD") of the fabric 10 respectively, which may be flat-woven and joined into endless form with a seam. Warp yarns 12 weave with weft yarns 14 in a weave pattern, wherein each warp yarn 12 passes over and under two or more successive weft yarns 14. It will be observed that each weft yarn 14 makes a float over one or more consecutive warp yarns 12 on the side of the fabric 10 shown in FIGS. 1 and 2.

Figure 2:
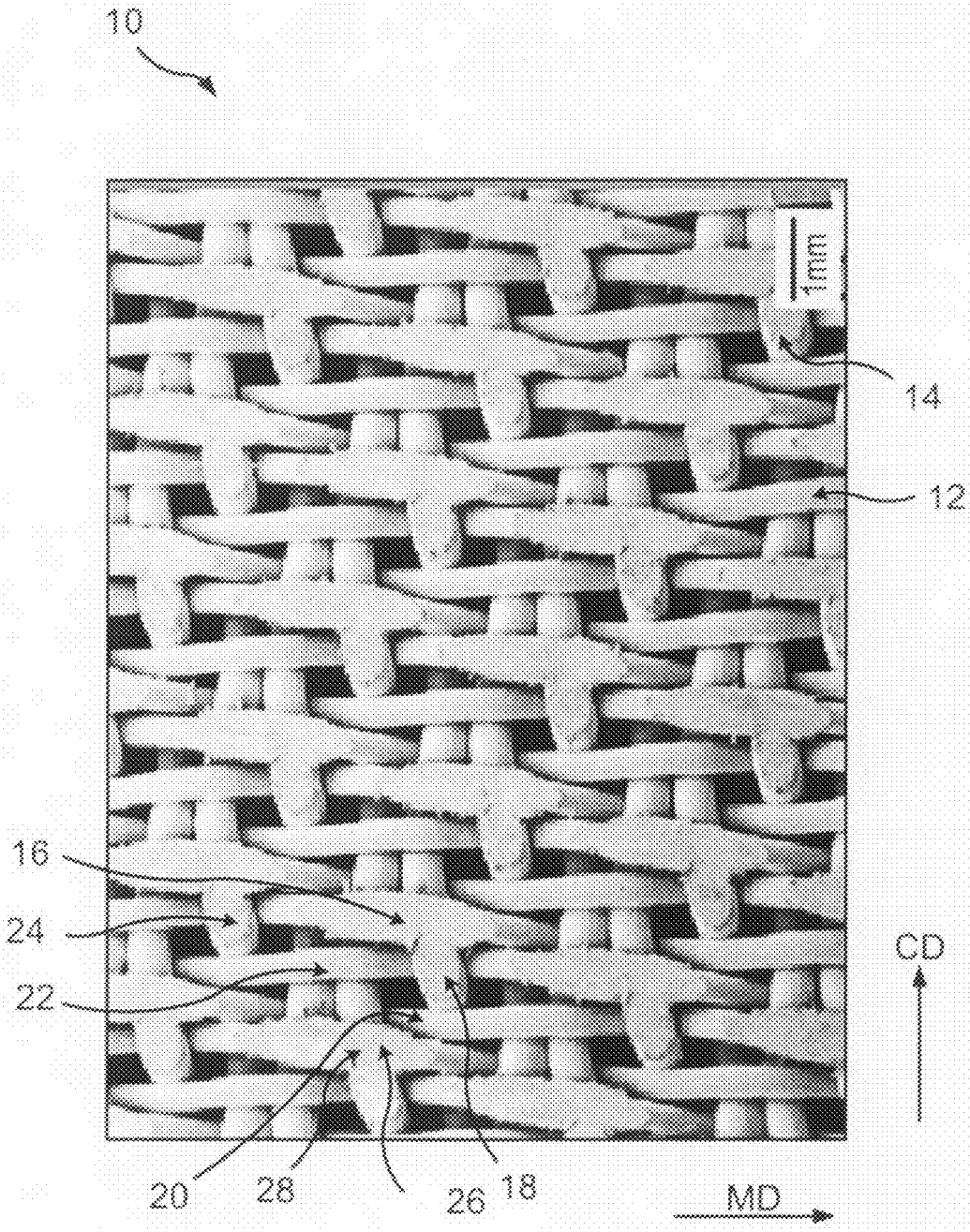
FIG. 2 shows a paper side view and a surface depth view highlighting the L-shaped knuckle pattern on the paper side surface of a preferred embodiment of the present invention.

According to the embodiment of the present invention, there are two long warp knuckles 16, 22, each residing in a different plane of the fabric 10. First long warp knuckle 16 floats over four weft yarns 14. One weft yarn 14 passes under the long warp knuckle 16 in an over-under-over configuration for support to the long warp knuckle 16. First long warp knuckle 16 is in a higher plane to facilitate sheet transfer to the Yankee dryer. The two first long warp knuckles 16, which are separated by two warp yarns 12, define the MD boundaries of the pocket 20. Two weft knuckles 18, 24, separated by two weft yarns 14, define the CD boundaries of the pocket 20. Second long warp knuckle 22 floats over three weft yarns 14. Second warp knuckle 22 is in a lower plane and is arranged diagonally across the pocket 20, as shown in FIG. 1. The second long warp knuckle 22 provides fiber support at the base of the pocket 20. FIGS. 1 and 2 show progressive sanding of the knuckles 16 and 18. While sanding was utilized for this illustration, other means, as aforementioned also may be used to obtain the desired result. In this regard, the MD yarns 16 were initially sanded to a length of 1.3 mm.

According to the present invention when the fabric 10 is sanded to a first long warp knuckle length of 1.7 mm, the first long warp knuckle 16 and first weft knuckle 18 begin to create an L-shaped pattern 28 with separate MD and CD knuckles that are non-continuous, as shown in FIG. 1. When the fabric 10 is further sanded to a first long warp knuckle length of 1.9 mm, the first long warp knuckle 16 and first weft knuckle 18 or portions thereof are now co-planar creating a continuous L-shaped knuckle pattern 26, as shown in FIG. 2 with increased contact area with the sheet and the attendant advantages as aforenoted. Note, the illustrated lengths or contact areas obtained after the stepwise sanding are used merely as an example since other dimensions may also be suitable for the purpose.

Pocket sizes can be characterized by an MD/CD dimension and/or by a pocket depth. The pockets are formed/bounded by weft yarns and warp yarns which are raised from the base plane of the fabric. The raised weft yarns and warp yarns are produced by knuckles in the weave pattern. The fabric base inside each pocket can be a plain weave pattern or any other suitable pattern. In addition, a pocket may include one or more raised or semi-raised warp yarns or weft yarns inside. The raised or semi-raised warp yarns or weft yarns may lie in the base of the pocket and may bisect the pocket area in parallel, perpendicular, or diagonal manner.

Warp yarns 12 and weft yarns 14 are preferably monofilament yarns of any of the synthetic polymeric resins used in the production of such yarns for paper machine clothing. Polyester and polyamide are but two examples for such materials. Other examples of such materials are yarns of polyphenylene sulfide (PPS), which is commercially available under the name RYTON®, and yarns of a modified heat-, hydrolysis, and contaminant-resistant polyester of the variety disclosed in commonly assigned U.S. Pat. No. 5,169,499 incorporated herein by reference and used in dryer fabrics sold by Albany International Corp. under the trademark THERMONETICS®. Any combination of polymers for any of the yarns can be used as identified by one of ordinary skill in the art. The yarns may have a circular cross-section with one or more different diameters or any other shape suitable for the purpose.

Note, the fabric according to the present invention may be formed using any weave pattern that produces an L-shaped knuckle pattern. The present invention is intended to cover other fabric patterns having different sizes and shapes of pockets. Accordingly, the present invention should not be construed as being limited to the embodiment disclosed above.

Modifications to the above would be obvious to those of ordinary skill in the art, but would not bring the invention so modified beyond the scope of the appended claims.

Although illustrative embodiments of the invention have been described in detail herein with reference to the accompanying drawings, it is to be understood that the invention is not limited to those precise embodiments, and that various changes and modifications can be effected therein by one skilled in the art without departing from the scope and spirit of the invention as defined by the appended claims.

What is claimed is:

1. A fabric for use on a papermaking machine, comprising:

a plurality of warp yarns interwoven with a plurality of weft yarns;

wherein said plurality of warp yarns float over two or more weft yarns to form a plurality of long warp knuckles;

wherein said plurality of weft yarns weave over one or more of warp yarns to form a plurality of weft knuckles;

wherein said plurality of long warp knuckles and said plurality of weft knuckles are formed on a plurality of planes; and wherein each long warp knuckle and its corresponding adjacent weft knuckle lying on a highest plane of said fabric are flattened to produce a co-planar L shaped pattern on a surface side of the fabric.

2. The fabric according to claim 1, wherein the fabric is flat-woven and joined into endless form with a seam.

3. The fabric according to claim 1, wherein the fabric comprises two long warp knuckles, each residing in a different plane of the fabric.

4. The fabric according to claim 3, wherein a first long warp knuckle floats over four weft yarns.

5. The fabric according to claim 4, wherein the first long warp knuckle is in a higher plane than an adjacent second warp knuckle.

6. The fabric according to claim 1, wherein the plurality of long warp knuckles lying on the highest plane are separated by two or more warp yarns.

7. The fabric according to claim 6, wherein one of the two or more separating warp yarns is a second long warp knuckle.

8. The fabric according to claim 7, wherein the second long warp knuckle lies diagonally in the base of a pocket thereby formed.

9. The fabric according to claim 1, wherein the plurality of weft knuckles lying on the highest plane are separated by two or more weft yarns.

10. The fabric according to claim 7, wherein the second long warp knuckle floats over three or more weft yarns.

11. The fabric according to claim 1, wherein the pattern is continuous.

12. The fabric according to claim 1, wherein each long warp knuckle and its corresponding adjacent weft knuckle lying on the highest plane are flattened by sanding, calendering or machining means.

13. The fabric according to claim 1, wherein the fabric is formed having a defined pocket area.

14. The fabric according to claim 1, wherein the fabric is a single layer TAD fabric.

15. The fabric according to claim 1, wherein at least some of the plurality of warp yarns and the plurality of weft yarns are monofilament yarns.

16. A method of forming a fabric for use on a papermaking machine, the method comprising the steps of:

interweaving a plurality of warp yarns with a plurality of weft yarns such that;

said plurality of warp yarns float over two or more weft yarns to form a plurality of long warp knuckles;

said plurality of weft yarns weave over one or more warp yarns to form a plurality of weft knuckles;

and said plurality of long warp knuckles and said plurality of weft knuckles are formed on a plurality of planes; and flattening each long warp knuckle and its corresponding adjacent weft knuckle lying on a highest plane of said fabric to produce a co-planar L shaped pattern on a surface side of the fabric.

17. The method according to claim 16, wherein the fabric is flat-woven and joined into endless form with a seam.

18. The method according to claim 16 further comprising the step of forming two long warp knuckles, each residing in a different plane of the fabric.

19. The method according to claim 18 further comprising the step of forming a first long warp knuckle that floats over four weft yarns.

20. The method according to claim 19, wherein the first long warp knuckle is formed in a higher plane than an adjacent warp knuckle.

21. The method according to claim 16, wherein the plurality of long warp knuckles lying on the highest plane are separated by two or more warp yarns.

22. The method according to claim 21, wherein one of the two or more separating warp yarns is a second long warp knuckle.

23. The method according to claim 22, wherein the second long warp knuckle lies diagonally in the base of a pocket thereby formed.

24. The method according to claim 16, wherein the plurality of weft knuckles lying on the highest plane are separated by two or more weft yarns.

25. The method according to claim 21, wherein the second long warp knuckle floats over three or more weft yarns.

26. The method according to claim 16, wherein the pattern is continuous.

27. The method according to claim 16, wherein each long warp knuckle and its corresponding adjacent weft knuckle lying on the highest plane are flattened by sanding, calendering or machining means.

28. The method according to claim 16, wherein the fabric is formed having a defined pocket area.

29. The method according to claim 16, wherein the fabric is a single layer TAD fabric.

30. The method according to claim 16, wherein at least some of the plurality of warp yarns and the plurality of weft yarns are monofilament yarns.

* * * * *